US007100402B2

(12) United States Patent
Holmgren

(10) Patent No.: US 7,100,402 B2
(45) Date of Patent: Sep. 5, 2006

(54) ANTI-THEFT DEVICE

(75) Inventor: Bertil Holmgren, Vellinge (SE)

(73) Assignee: MW Security AB, Malmo (SE)

( * ) Notice: Subject to any disclaimer, the term of this patent is extended or adjusted under 35 U.S.C. 154(b) by 87 days.

(21) Appl. No.: 10/516,769

(22) PCT Filed: Jun. 4, 2003

(86) PCT No.: PCT/SE03/00902

§ 371 (c)(1),
(2), (4) Date: Dec. 3, 2004

(87) PCT Pub. No.: WO03/102336

PCT Pub. Date: Dec. 11, 2003

(65) Prior Publication Data

US 2005/0172682 A1 Aug. 11, 2005

(30) Foreign Application Priority Data

Jun. 4, 2002 (SE) ..... 0201683

(51) Int. Cl.
*E05B 65/00* (2006.01)
*B65D 85/57* (2006.01)

(52) U.S. Cl. ..... 70/57.1; 70/63; 206/1.5; 206/308.2; 206/387.11

(58) Field of Classification Search ..... 70/57.1, 70/63, 276, 158–162; 206/1.5, 308.2, 387.11
See application file for complete search history.

(56) References Cited

U.S. PATENT DOCUMENTS 2,086,534 A * 7/1937 Byrne ..... 220/811
4,048,050 A * 9/1977 Hillman ..... 206/1.5
4,807,759 A * 2/1989 Castner ..... 220/4.02
5,375,712 A * 12/1994 Weisburn ..... 206/387.11
5,468,031 A * 11/1995 Holmgren ..... 292/81
5,760,689 A * 6/1998 Holmgren ..... 340/568.8
6,125,668 A * 10/2000 Belden, Jr. ..... 70/57.1
6,886,691 B1 * 5/2005 Burdett et al. ..... 206/387.11
2004/0163977 A1 * 8/2004 Sedon et al. ..... 206/308.2
2004/0200744 A1 * 10/2004 Mitsuyama ..... 206/308.2
2005/0279143 A1 * 12/2005 Belden et al. ..... 70/57.1

FOREIGN PATENT DOCUMENTS

| | | |
|---|---|---|
| EP | 0 616 103 A1 | 9/1994 |
| WO | WO 00/61899 | 10/2000 |
| WO | WO 00/75469 A1 | 12/2000 |
| WO | WO 01/83325 A2 | 11/2001 |

* cited by examiner

*Primary Examiner*—Lloyd A. Gall
(74) *Attorney, Agent, or Firm*—Merchant & Gould P.C.

(57) ABSTRACT

An anti-theft device comprising a container formed by a box (10) and a lid (11) hinged together. A lock slide (15) inside the box can be displaced between a disengaged position and an engaged position. A flange (22) on the lid forms an L-shaped slot. A first limb (23A) of the slot is perpendicular to a free edge of the flange and opens in the edge to receive a projection on the lock slide in the disengaged position thereof. A second limb (23B) of the slot extends transversely of the first limb to receive the projection when the lock slide is in the engaged position. A latch mechanism (26, 28) latching the lock slide in the engaged position can be actuated by a special tool to unlatch the lock slide and allow displacement thereof to the disengaged position.

11 Claims, 5 Drawing Sheets

ANTI-THEFT DEVICE

BACKGROUND OF THE INVENTION

1. Field of the Invention

This invention relates to an anti-theft device for displaying particularly expensive and attractive goods in shops and department stores, of the kind comprising a container formed by a first part and a second part hinged together, a lock slide inside said first part, which includes at least one projection and can be displaced manually between an engaged position in which the projection engages said second part to lock the parts together in a closed position of the container, and a disengaged position allowing opening of the container, a latch mechanism for latching the lock slide in the engaged position, which can be actuated by means of a special tool to unlatch the lock slide and allow displacement thereof to the disengaged position, and an element for wireless activation of an alarm if the anti-theft device is carried through an exit of the shop or the department store.

2. Description of the Prior Art

An anti-theft device of this kind is disclosed in EP 0 616 103 B1 wherein the container comprises a lower-part and a lid, projections on the lock slide and the lid inter-engaging in the closed position of the container. The lock slide is mounted in the lower-part for displacement along a partition therein. In the engaged position the lock slide is latched to the partition by means of spring blades on the partition which engage the lock slide and can be disengaged by the spring blades being actuated mechanically or magnetically in order to allow displacement of the lock slide to the disengaged position when the container is to be opened.

This prior art anti-theft device does not provide a satisfactory protection against theft of the objects displayed in the container because it can be opened too easily by means of a tool inserted between the lower-part and the lid the projections being broken off when the lower-part and the lid are separated by means of the tool.

EP 0 731 870 B1 describes an anti-theft device wherein the lock slide is provided with lock bolts which are brought into and out of engagement with the box by means of the lock slide which is operated by means of an operating slide parallel with the lock slide. The operating slide can be displaced back and forth manually and is operatively connected with the lock slide in such a way that the displacement of the operating slide is converted into a displacement of the lock slide in the transverse direction of the displacement of the operating slide. The lock slide is latched in the locking position by means of a latch mechanism described in EP 0581 811 B1. The housing thereof is available on the outside of the anti-theft device and forms a finger grip for the manual displacement of the operating slide between engaged and disengaged position.

The anti-theft device disclosed in EP 0 731 870 B1 is of a complicated construction as the lock mechanism thereof includes two slides, a lock slide and an operating slide, operatively interconnected.

BRIEF SUMMARY OF THE INVENTION

The object of the invention is to overcome the drawbacks of the prior art anti-theft devices described above.

For this purpose the invention provides an anti-theft device of the kind referred to herein which according to claim 1 is characterized in that a flange on said second part-forms at least one L-shaped slot a first limb thereof opening in a free edge of the flange to receive the projection therein at closing of the container with the lock slide in the disengaged position, and a second limb extending transversely of said first limb and receiving the projection when the lock slide is displaced to the engaged position.

Further features of the invention are defined in the dependent claims.

BRIEF DESCRIPTION OF THE DRAWING

Illustrative embodiments of the anti-theft device will be described with reference to the accompanying drawings in which.

DETAILED DESCRIPTION OF THE INVENTION

Figure 1:
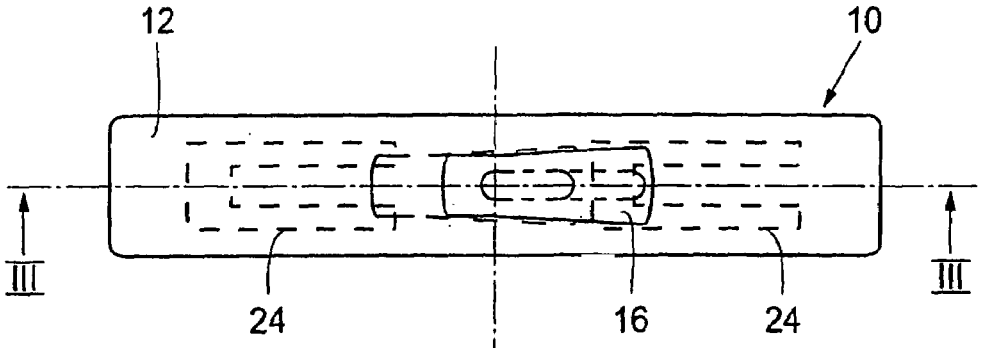
FIG. 1 is a top plan view of a first embodiment of the device.
Figure 2:
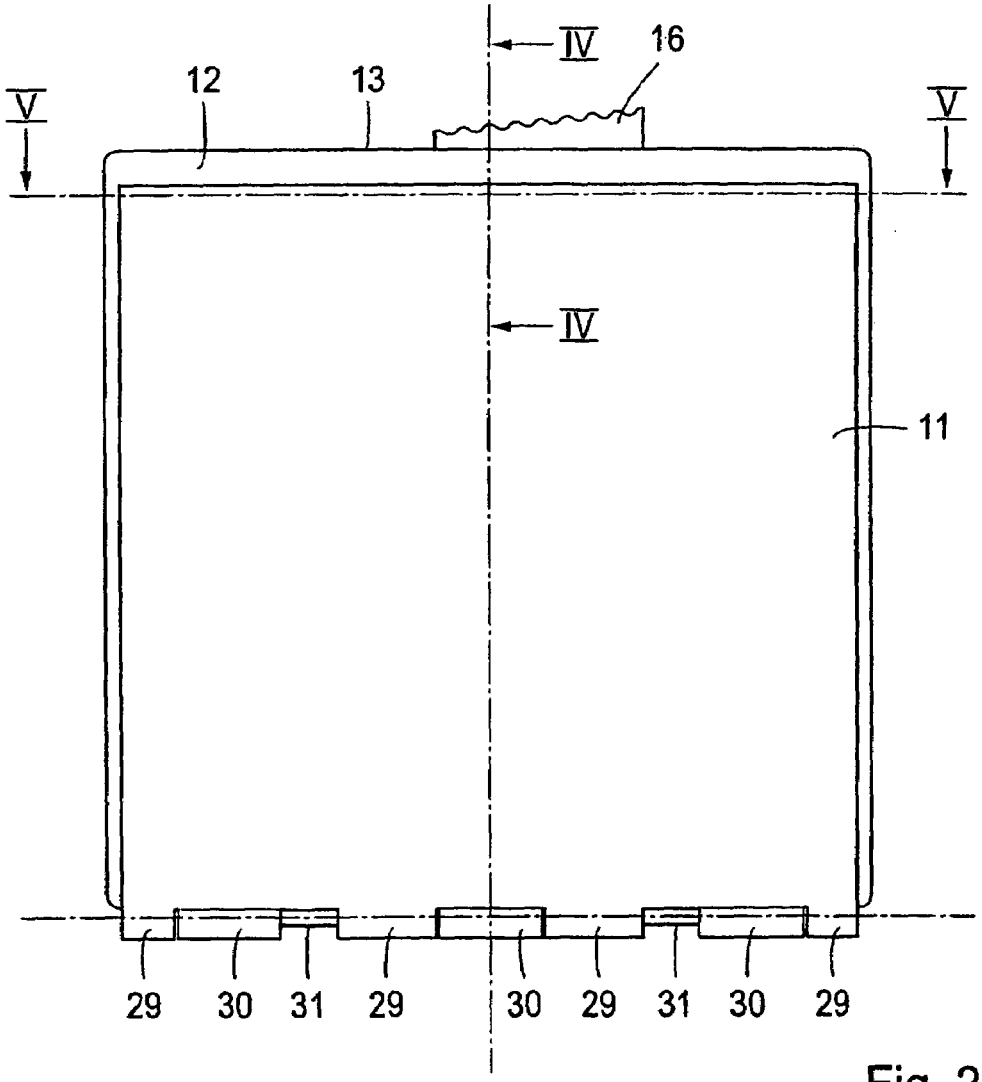
FIG. 2 is a side view of the device in FIG. 1.

The anti-theft device shown in FIGS. 1 to 14 of the drawing comprises a parallelepipedic container for receiving the object or objects to be protected against theft, which is formed by a box 10 and a lid 11. The box has an upper end wall 12 with a flat outside surface 13 and a flat inside surface 14 the surfaces being parallel with each other. Lid 11 is connected with the box by a hinge to be described in more detail below, for swinging movement as indicated by a double arrow in FIG. 4, between open and closed position. The lid forms a side wall of the container in the closed position thereof. The box and the lid preferably are injection molded of suitable rigid and strong plastics preferably transparent plastics.

A lock mechanism for locking the lid in the closed position includes a flat lock slide 15 which can be displaced longitudinally along surface 14 between a left end position and a right end position. Such displacement is effected manually by means of an outside finger-grip 16 which is located on surface 13 and is connected with the lock slide 15 by means of a pin 17 extending through end wall 12 the pin being displaceably received in a longitudinal slot 18 in end wall.

Lock slide 15 forms a unit together with a flat rail 19 which extends along the lock slide and is connected therewith by three pins 20 mutually spaced, a space 21 being provided between the lock slide and the rail.

Lid 11 forms a flange 22 projecting at right angles from the inside surface of the lid at the upper end thereof. The flange is dimensioned to be received in space 21 provided between lock slide 15 and rail 19, and forms three L-shaped slots, FIG. 5, having a limb 23A at right angle to the free edge of the flange and opening at said edge, and a limb 23B at right angle to limb 23A and extending longitudinally of the flange. Limbs 23A are mutually spaced and the spacing thereof is the same as the spacing of pins 20.

With the lock slide and thus the rail in the left end position pins 20 are in register with limbs 23A, and when the lid is being closed and the flange is being received in space 21, pins 20 will be received in limbs 23A. By displacement of the lock slide to the right end position the pins will be displaced along limbs 23B to the position shown in FIG. 5. With pins 20 in this position flange 22 is caught between the lock slide and the rail with the container closed, in order to release the lid the lock slide with the rail has to be displaced to the left end position so that the pins are located in register with limbs 23A and flange 22 can be withdrawn from the space between the lock slide and the rail at opening of the container.

Figure 3:
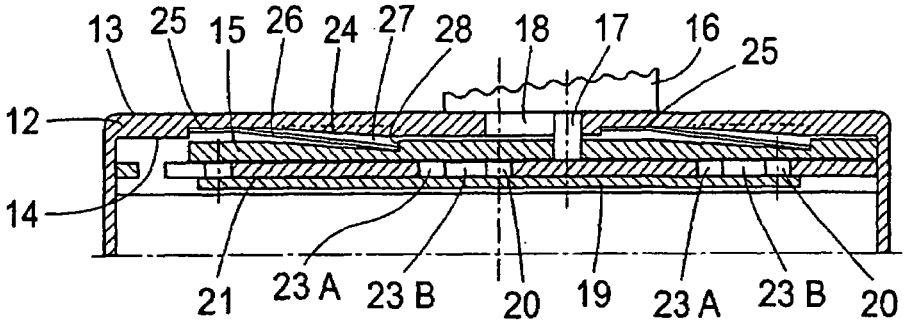
FIG. 3 is a cross sectional view along line III—III in FIG. 1.
Figure 4:
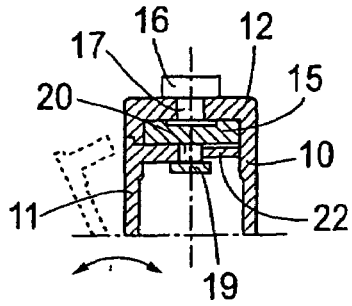
FIG. 4 is a cross sectional view along line IV—IV in FIG. 2.
Figure 5:
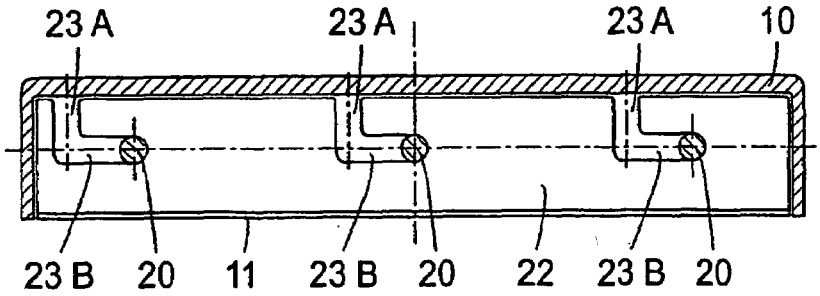
FIG. 5 is a cross sectional view along line V—V in FIG. 2.
Figure 6:
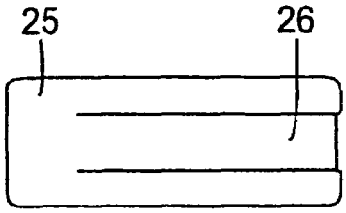
FIG. 6 is an enlarged plan view of a plate forming a spring tongue.
Figure 7:
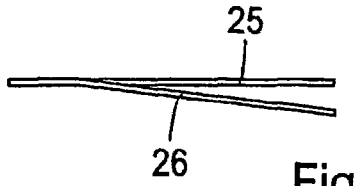
FIG. 7 is a central longitudinal cross-sectional view of the plate in FIG. 6.
Figure 8:
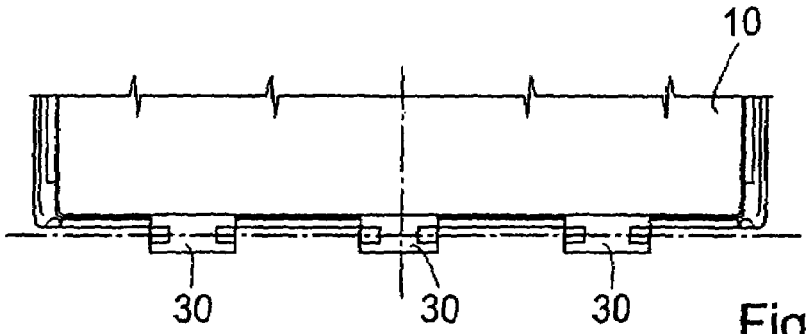
FIG. 8 is a fragmentary side view of the lower portion of one of the parts forming the container, as seen from the inside of said part.
Figure 9:
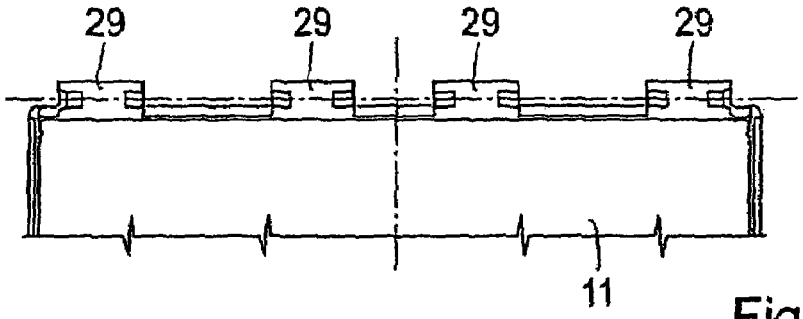
FIG. 9 is a view, corresponding to FIG. 8 of the other part of the container.

In order to securely lock lid 14 in the closed position the device comprises a latch mechanism for latching the lock slide in the right end position. The latch mechanism is of the type disclosed in WO-A-00/75469 and comprises two U-shaped shallow depressions 24 in surface 14 said depressions being mutually spaced in the longitudinal direction of end wall 12. A plate 25 of spring steel has a centrally punched tongue 26 which is directed obliquely downwards from the plate, the plate being U-shaped with a web from which the tongue extends, and two limbs one at each side of the tongue. The shape of plate 25 is in agreement with the shape of depression 24, and in each of these depressions such a plate is loosely placed with tongue 26 directed from surface 14 towards the lock slide 15. Tongue 26 of each of the plates has the free end thereof in a recess 27 in the upper surface of the lock slide. When the lock slide is in the right end position the tongue engages at the free end thereof a shoulder 28 formed by the recess. The tongues as a consequence thereof prevent displacement of the slide to the left as seen in FIG. 3 to the disengaged position. Plates 25 shall be of a spring steel which can be attracted by magnets—permanent magnets or electromagnets—being moved externally towards the outside surface 13 of end wall 12 in register with tongues 26. When the tongues are attracted by the magnets they will be bent upwards against the bottom of the associated depression 24 so that the tongue will be disengaged from shoulder 28 and lock slide 15 will be free for manual displacement to the left end position allowing opening of the lid.

Figure 10:
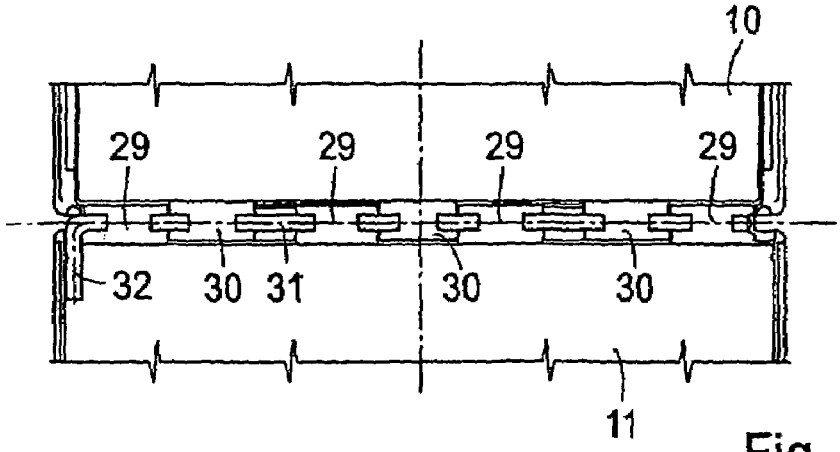
FIG. 10 is a view, corresponding to FIGS. 8 and 9 with the two parts of the container hingedly interconnected and shown in an open position.
Figure 11:
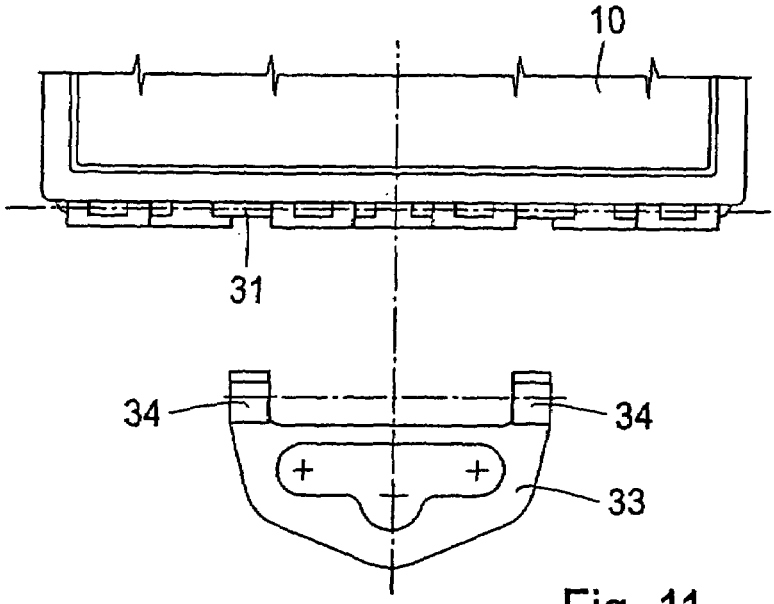
FIG. 11 is a fragmentary side view of the lower portion of the closed container, as seen from the outside thereof, a hanger to be attached to the container being shown in side view, separated from the container.
Figure 12:
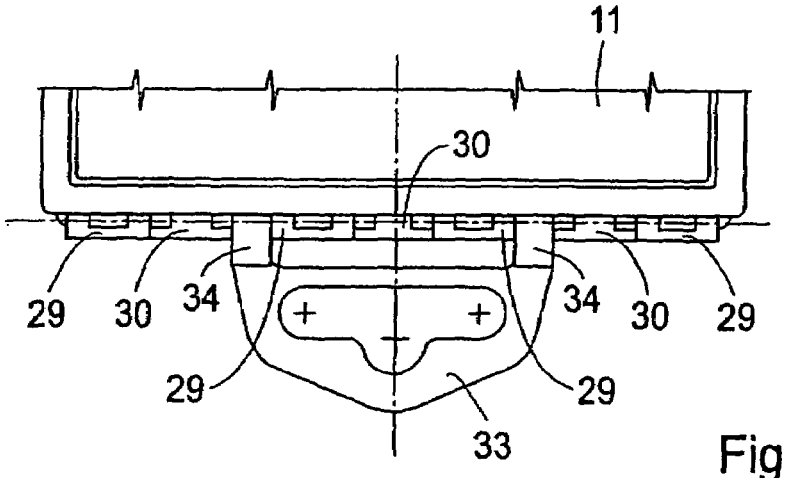
FIG. 12 is a view as that in FIG. 11 with the hook attached to the container.
Figure 13:
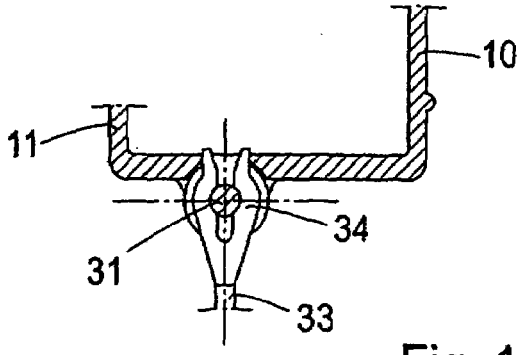
FIG. 13 is a fragmentary transverse cross sectional view of the lower part of the container showing the attachment of the hanger.

The hinge connection between the box 10 and the lid 11 will be described in more detail with reference to FIGS. 2 and 8 to 10. One of said two parts forming the container of the anti-theft device of the invention—in the embodiment shown lid 11—forms four mutually spaced sockets 29, and the other part—box 10—forms three mutually spaced sockets 30. The sockets are located such that sockets 30 are received in the spaces between sockets 29. The sockets are aligned, and a pin 31 is passed through the sockets and is locked in this position by a perpendicularly angled end portion 32 which by rotation of the pin has been located inside the lid abutting an edge wall thereof as shown in FIG. 10. Box and lid can easily be separated at the hinge for example in order to replace a box having a certain depth by a box having another depth, smaller or larger, in order to adapt the volume of the container to the size of the goods to be displayed therein.

Sometimes it may be desired to expose goods enclosed in anti-theft devices as described in a rack in which each anti-theft device is suspended from a projecting prong. In order to allow suspension of the anti-theft device it can be combined with a hanger 33 formed as a hook or an eye, FIGS. 11 to 13, which forms two forked projections 34. This hanger is attached to exposed portions of pin 31 at the forked projections. Preferably this is done with the lid open, and then, when the lid is closed, the forked projections will be clamped between the box and the lid providing a secure connection of the hanger to the anti-theft device.

In a modification of the embodiment described above rail 19 is dispensed with, which does not make the device less effective. However, it is preferred that the anti-theft device is provided with such a rail because the lock mechanism is more sturdy if flange 22 in the closed condition of the container is received in space 21 between lock slide 15 and rail 19.

Figure 14:
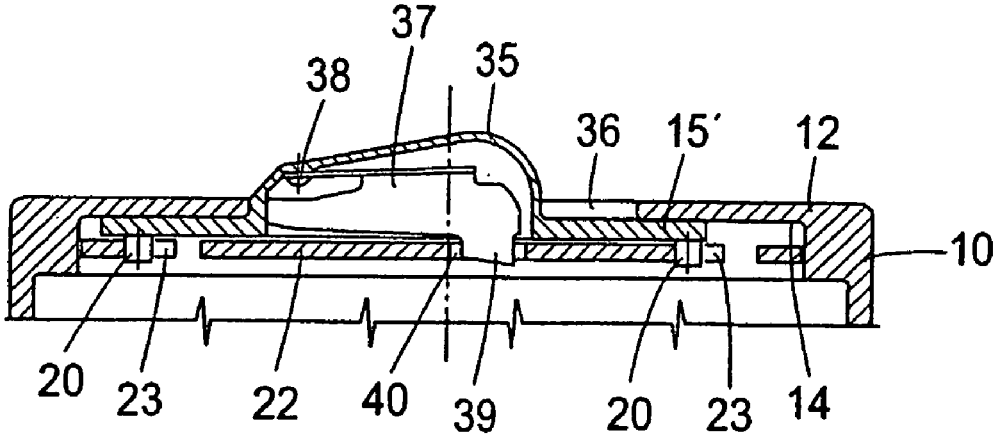
FIG. 14 is a fragmentary cross sectional view as that in FIG. 3 of the top portion of a second embodiment of the device shown in the locked position.
Figure 15:
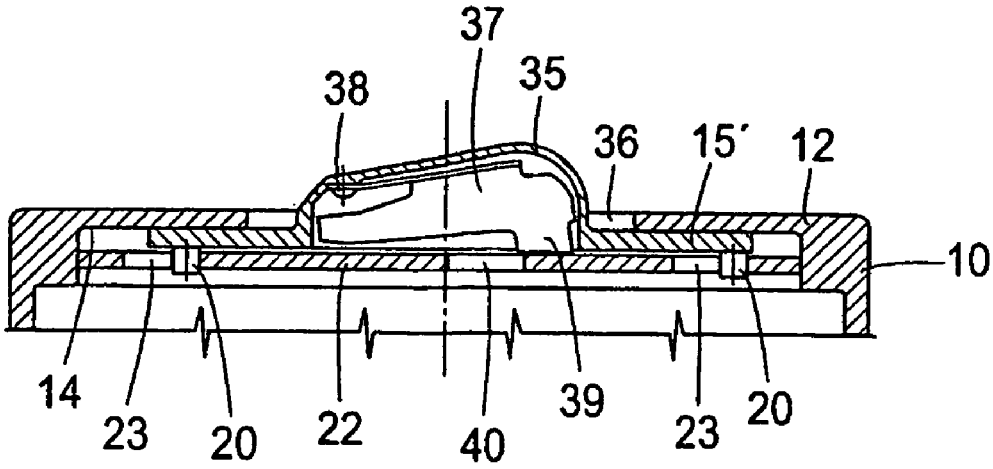
FIG. 15 is a view corresponding to that in FIG. 14 of the device in the unlocked position.

In the embodiment disclosed in FIGS. 14 and 15 the box and the lid are interconnected by a hinge e.g. of the type described above. The lock slide 15' is made integral with a housing 35 which is mounted in an opening 36 in end wall 12 for displacement of the lock slide along the flat inside surface 14 of wall 12. The housing forms a finger grip for manual displacement of the slide and is open at the bottom thereof. The mounting of the slide can be made as described in EP 0 731 870 B1. Pins 20 on the slide co-operate with L-shaped slots 23 in flange 22 projecting from lid 11 as described above. However, the latch mechanism for latching the lock slide in the engaged position differs from that provided in the embodiment first described. The latch mechanism principally is of the type described in EP 0581 811 B1 and comprises a spring tongue 37 mounted in the housing at one end 38 thereof. The spring tongue is made of a material which can be attracted by a magnet and forms an angled flap 39 at the other end thereof. When the lock slide is in the engaged position the spring tongue engages at flap 39 an aperture 40 in flange 22 as shown in FIG. 15. The spring blade can be disengaged from flange 22 by means of a magnet which attracts the spring tongue so that flap 39 is withdrawn from aperture 40 and the lock slide can be displaced for moving pins 20 from limbs 23B of the L-shaped slots in flange 22 so that the pins are located in register with limbs 23A and the lid can be opened, all in the same manner as described with reference to the first embodiment.

The anti-theft device should be provided with an element (not shown herein) for wireless actuation of an electronic alarm if the device is carried through an exit of a shop or department store or a defined area therein, as is well known in the art.

The invention claimed is:

1. Anti-theft device for displaying goods in shops and department stores, comprising a container formed by a first part and a second part hinged together, a lock slide inside said first part, which includes at least one projection and can be displaced manually between an engaged position in which the projection engages said second part to lock the parts together in a closed position of the container, and a disengaged position allowing opening of the container, a latch mechanism for latching the lock slide in the engaged position, which can be actuated by means of a special tool to unlatch the lock slide and allow displacement thereof to the disengaged position, and an element for wireless activation of an alarm if the anti-theft device is carried through an exit of the shop or the department store, wherein said first part comprises a first plane surface and, perpendicular to said first plane surface, an end wall at which said lock slide is displaceable in a plane parallel to said end wall, said second part comprises a second plane surface, which in a closed position for the container is parallel to the first plane surface, and, perpendicular to said second plane surface, a flange which in a closed position for the container is arranged parallel to said lock slide, where said flange, forms at least one L-shaped slot, a first limb of which is perpendicular to a free edge of the flange and opens in said edge to receive the projection therein at closing of the container with the lock slide in the disengaged position, and a second limb of which extends transversely of said first limb to receive the projection when the lock slide is displaced to the engaged position.

2. Anti-theft device according to claim 1 wherein the lock slide includes several projections and the flange (22) forms a corresponding number of L-shaped slots, said first limbs having the same spacing as the projections.

3. The anti-theft device of claim 2 wherein the projections connect a flat surface of the lock slide with a flat surface of a rail extending along the lock slide, the flat surfaces being mutually spaced, and wherein the flange on said second part is received in the space between the flat surfaces when the container is closed.

4. Anti-theft device according to claim 1 wherein the latch mechanism comprises a spring tongue which is biased by spring action to engaged position but can be actuated to disengaged position by attraction to a magnet functioning as the special tool.

5. Anti-theft device according to claim 4 wherein the spring tongue is integral with a plate received by a depression in an inside surface of the container, facing the lock slide.

6. Anti-theft device according to claim 5 wherein the lock slide forms a shoulder, the spring tongue engaging the shoulder in the engaged position of the latch mechanism.

7. Anti-theft device according to claim 4 wherein the spring tongue is fixedly attached at one end thereof and forms an angled flap at the other end which in the engaged position of the latch mechanism engages an aperture in the flange.

8. Anti-theft device according to claim 7 wherein the spring tongue is enclosed by a housing connected with the lock slide and projecting from said first part of the container to form a finger-grip available on the outside of the container for manual displacement of the lock slide.

9. Anti-theft device according to claim 1 wherein a hinge interconnecting said first and second parts of the container comprises a pin and sockets on said parts, receiving the pin which can be withdrawn from the sockets to separate the parts for exchange of one or the other of the parts.

10. Anti-theft device according to claim 9 wherein a hanger for suspension of the anti-theft device in a rack forms forked projections which are engaged with exposed portions of the pin.

11. Anti-theft device for displaying goods in shops and department stores, comprising a container formed by a first part and a second part hinged together; a lock slide inside said first part, which lock slide includes at least one projection; a flange extending from an edge of said second part, said flange forming at least one L-shaped slot; where said lock slide is manually displaceable between an engaged position in which said projection engages said L-shaped slot to lock the parts together in a closed position of the container, and a disengaged position allowing opening of the container; and a latch mechanism (26, 37) for latching the lock slide in the engaged position, wherein said first part comprises a first plane surface and an end wall perpendicular to said first plane surface, at which end wall said lock slide is displaceable in a plane parallel to said end wall, where said second part comprises a second plane surface, which in a closed position for the container is parallel to the first plane surface, and wherein said flange extends perpendicular to said second plane surface and is arranged parallel to said lock slide in said closed position for the container.

* * * * *